United States Patent [19]

Sawada et al.

[11] 4,391,256

[45] Jul. 5, 1983

[54] AIR-FUEL RATIO CONTROL APPARATUS

[75] Inventors: Hiroshi Sawada; Takayuki Demura, both of Susono, Japan

[73] Assignee: Toyota Jidosha Kogyo Kabushiki Kaisha, Aichi, Japan

[21] Appl. No.: 406,574

[22] Filed: Aug. 9, 1982

Related U.S. Application Data

[63] Continuation of Ser. No. 153,521, May 27, 1980, abandoned.

[30] Foreign Application Priority Data

Jun. 4, 1979 [JP] Japan ..... 54-68804

[51] Int. Cl.[3] ..... F02B 3/08

[52] U.S. Cl. ..... 123/489; 123/589; 60/276

[58] Field of Search ..... 123/489, 478, 589; 60/276, 285

[56] References Cited

U.S. PATENT DOCUMENTS

| | | | |
|---|---|---|---|
| 4,120,269 | 10/1978 | Fujishiro | 123/489 |
| 4,153,023 | 5/1979 | Asano et al. | 123/489 |
| 4,167,925 | 9/1979 | Hosaka et al. | 123/489 |
| 4,215,656 | 8/1980 | Manaka et al. | 123/489 |
| 4,224,911 | 9/1980 | Mitsuda et al. | 123/589 |
| 4,232,517 | 11/1980 | Sumiyoshi et al. | 60/276 |
| 4,271,667 | 6/1981 | Mitsuda et al. | 123/589 |
| 4,276,745 | 7/1981 | Takada et al. | 60/276 |

FOREIGN PATENT DOCUMENTS

| | | | |
|---|---|---|---|
| 2037021 | 7/1980 | United Kingdom | 123/489 |

*Primary Examiner*—Parshotam S. Lall
*Attorney, Agent, or Firm*—Parkhurst & Oliff

[57] ABSTRACT

An average air-fuel ratio detection circuit for generating a signal which indicates the average value of a detection signal from an air-fuel ratio sensor, and a reference value control circuit are provided in the air-fuel ratio control apparatus. The reference value control circuit controls the reference value of a comparison circuit which compares the value of the detection signal from the air-fuel ratio sensor with the reference value, in accordance with the generated signal from the average air-fuel ratio detection circuit.

3 Claims, 9 Drawing Figures

AIR-FUEL RATIO CONTROL APPARATUS

This is a continuation of application Ser. No. 153,521 filed May 27, 1980, now abandoned.

BACKGROUND OF THE INVENTION

The present invention relates to an air-fuel ratio control apparatus utilized for an internal combustion engine.

There is known an air-fuel ratio feedback control system (closed-loop air-fuel ratio control system) for compensating the mass ratio of air and fuel in an internal combustion engine by controlling the additional air or fuel supplied to the engine in accordance with a detection signal from an air-fuel ratio sensor. The air-fuel ratio sensor detects the actual air-fuel ratio condition of the engine by detecting whether the concentration value of a predetermined component, for example, the oxygen component, in the exhaust gas is greater than or less than a predetermined value. In an internal combustion engine having such a conventional closed-loop air-fuel ratio control system and also having an open-loop air-fuel ratio control system, for example, a carburetor or an open-loop controlled fuel injection system, if the air-fuel ratio controlled by the open-loop system deviates from the correct one, or if a variable of the air-fuel ratio which is controlled according to the closed-loop system always has a fixed deviation, the average value of the final controlled air-fuel ratio of the engine (hereinafter called the average air-fuel ratio) deviates from a desired air-fuel ratio, in spite of the closed-loop control. This is because, according to the conventional closed-loop control system, the air-fuel ratio is not controlled by detecting the deviation value of the actual air-fuel ratio from a desired value, but is controlled by detecting whether the actual air-fuel ratio is greater than or less than a desired value. If the average air-fuel ratio deviates from the desired value, the purifying efficiency of a catalytic converter for reducing the noxious components in the exhaust gas will significantly decrease.

SUMMARY OF THE INVENTION

It is, therefore, an object of the present invention to provide an air-fuel ratio control apparatus, whereby the average air-fuel ratio can always be maintained at a desired value.

According to the present invention, an air-fuel ratio control apparatus comprises:

an air-fuel ratio sensor for generating a detection signal which indicates the concentration value of a predetermined constituent in the exhaust gas;

a comparison circuit for comparing the value of the detection signal with a reference value and for generating a control signal which indicates the result of the comparison;

an average air-fuel ratio detection circuit for generating a signal which indicates the average value of the detection signal from the air-fuel ratio sensor;

a reference value control circuit, responding to the generated signal from the average air-fuel ratio detection circuit, for increasing or decreasing the reference value of the comparison circuit, and;

means, responding to the control signal from the comparison circuit, for determining the ratio of air and fuel being applied to the engine.

The above-mentioned and other related objects and features of the present invention will be apparent from the following description of the present invention with reference to the accompanying drawings, as well as from the appended claims.

DETAILED DESCRIPTION OF THE PREFERRED EMBODIMENTS

Figure 1:
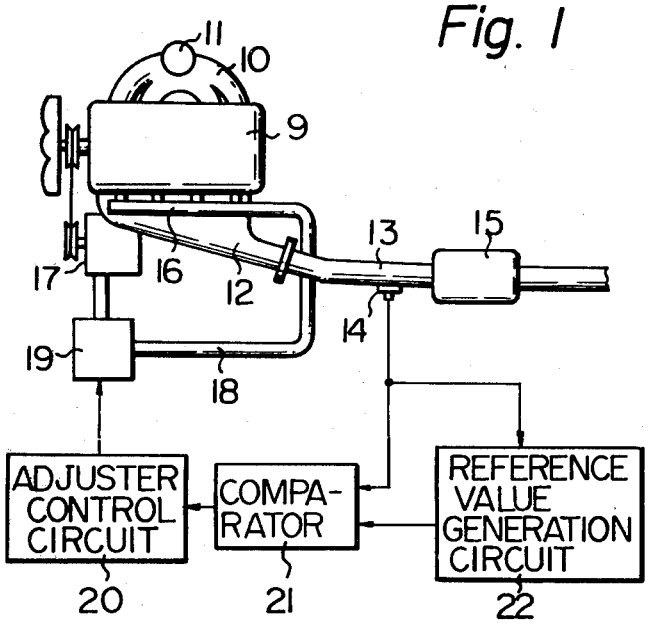
FIG. 1 is a schematic diagram of an embodiment according to the present invention.

FIG. 1 illustrating schematically an air-fuel ratio feedback control system, which is an embodiment of the present invention, for controlling the amount of secondary air fed into an exhaust system of an internal combustion engine, by using a detection signal from an air-fuel ratio sensor. Referring to FIG. 1, reference numeral 9 denotes an engine body, 11 a carburetor disposed upstream from an intake manifold 10 of the engine and 12 an exhaust manifold. An exhaust pipe 13 is connected downstream of the exhaust manifold 12. An air-fuel ratio sensor 14 is mounted on the exhaust pipe 13. The air-fuel ratio sensor 14 of this embodiment is a well-known oxygen concentration sensor using zirconium oxide as an oxygen ion conductor. The sensor 14 generates a detection signal in accordance with the concentration of the oxygen component in the exhaust gas. A catalytic converter 15 is mounted in the exhaust pipe 13 downstream of the air-fuel ratio sensor 14. The catalytic converter 15 is composed of a three-way catalytic converter for simultaneously reducing the three main pollutants, i.e., the $NO_x$, CO and HC components, in the exhaust gas.

A secondary air manifold 16, for injecting secondary air into the exhaust manifold 12, is mounted on the exhaust portion of the exhaust manifold 12. Discharged air from an air pump 17, which is driven by the engine, is introduced into the secondary air manifold 16 via a conduit 18 and an air-flow adjuster 19. The air-flow adjuster 19 controls the amount of secondary air flow passing through the conduit 19. The air-flow adjuster 19 may be embodied by an electromagnetic air flow control valve which directly adjusts the amount of passing air in accordance with electrical signals fed from an adjuster control circuit 20, or; may be embodied by an air flow control valve which adjusts the amount of passing air in accordance with a vacuum applied thereto via an electromagnetic valve which is controlled by the electrical signals from the adjuster control circuit 20.

An output of the air-fuel ratio sensor 14 is connected to one input of a comparator 21 and to an input of a reference value generation circuit 22, so that a detection signal from the sensor 14 is applied to both of the inputs. The other input of the comparator 21 is connected to an output of the reference value generation circuit 22, so that a reference voltage indicating a reference value controlled by the circuit 22 is applied to this input of the comparator 21. An output of the comparator 21 is connected to an input of the adjuster control circuit 20. The control circuit 20 produces, in accordance with the result of a comparison of the comparator 21, the electrical signals for controlling the air-flow adjuster 19. Although various well-known circuits can be employed as the adjuster control circuit 20, the simplest structure thereof may be composed of an integrator whose output is the integral of the result of the comparison by the comparator 21 and a converter which generates a square-wave signal having a duty ratio corresponding to the output of the integrator. The reference value generation circuit 22 is constructed so as to produce a signal which indicates the average air-fuel ratio of the engine from the detection signal fed from the air-fuel ratio sensor 14 and, then, to control the reference value in accordance with the produced signal.

Hereinafter, the detailed structure and operation of the reference value generation circuit 22 will be described by using examples.

Figure 2:
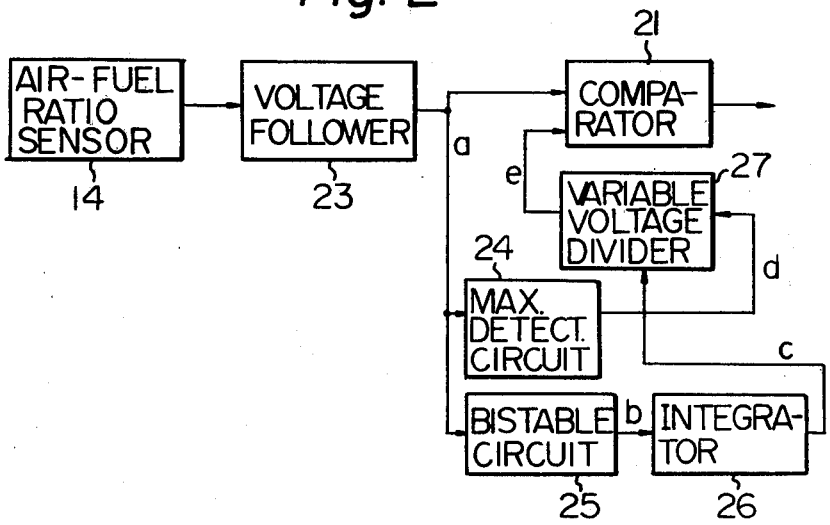
FIG. 2 is a schematic block diagram illustrating one example of the electrical circuit elements shown in FIG. 1.
Figure 3:
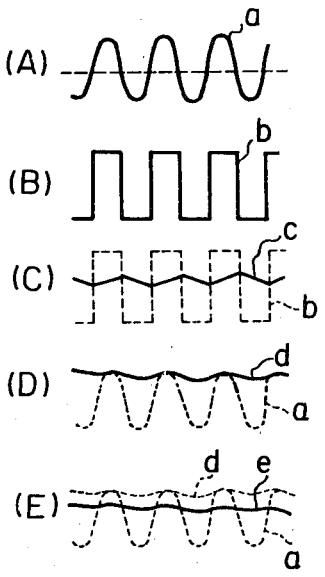
FIG. 3 contains waveforms obtained at various points in the circuit elements illustrated in FIG. 2.

FIG. 2 illustrates one example of the circuit elements corresponding to the air-fuel ratio sensor 14, the comparator 21 and the reference value generation circuit 22, illustrated in FIG. 1, and FIG. 3 illustrates waveforms obtained at various points in the circuit elements illustrated in FIG. 2. Referring to FIG. 2, reference numeral 23 denotes a voltage follower having a very high input impedance, which is matched with the output impedance of the air-fuel ratio sensor 14, and having a very low output impedance. A detection signal a, shown in FIG. 3-(A), from the air-fuel ratio sensor 14 is applied to a maximum value detection circuit 24 via the voltage follower 23. The maximum value detection circuit 24 produces a maximum value signal d, shown in FIG. 3-(D), having a voltage level corresponding to the maximum value of the detection signal a. This maximum value detection circuit 24 can be easily embodied by well-known circuits, for example, a circuit having a diode and a capacitor connected in series, and having outputs connected across the capacitor.

The detection signal a from the voltage follower 23 is also applied to a bistable trigger circuit 25, which can be composed, for example, of a Schmitt-trigger circuit. The bistable trigger circuit 25 converts the detection signal into a square-wave signal b, shown in FIG. 3-(B), by a switching action, triggered at a predetermined point in each positive and negative swing of the detection signal. The square-wave signal b is applied to an integrator 26, which can be composed of a well-known integration circuit using an operational amplifier. The integrator 26 generates a signal c, shown in FIG. 3-(C), which is the integral of the square-wave signal b with respect to time. This signal c from the integrator 26 has a voltage level corresponding to a duty ratio of the square-wave signal b.

A variable voltage divider 27 divides the voltage level of the maximum value signal d from the maximum value detection circuit 24 by a variable division factor and, thus, produces a reference value signal e, shown in FIG. 3-(E). The variable division factor of the divider 27 is controlled in accordance with the voltage level of the signal c fed from the integrator 26. The higher the voltage level of the signal c increases, the greater the division factor varies, so as to cause the voltage level of the reference value signal e to decrease, and vice versa. The reference value signal e from the divider 27 is applied to the comparator 21. This variable voltage divider 27 can be easily embodied by a series arrangement of at least one resistor and a FET element whose gate is connected to the output of the integrator 26, so that the FET element receives the signal c from the integrator 26.

As will be apparent from the foregoing description, according to the embodiment shown in FIG. 2, the voltage level of the reference value signal e applied to the comparator 21 can be controlled to a level corresponding to a duty ratio of the detection signal from the air-fuel ratio sensor 14.

Figure 4:
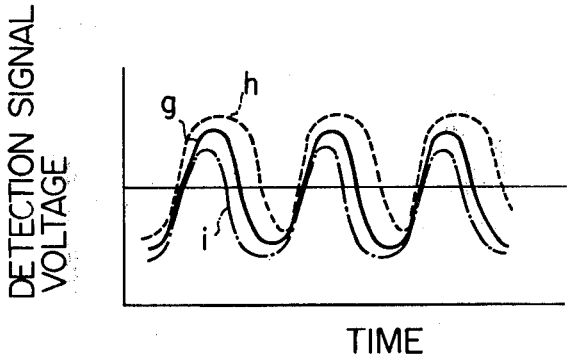
FIG. 4 contains waveforms of detection signals from an air-fuel ratio sensor.

In an air-fuel ratio feedback control system using an air-fuel ratio sensor, if the average air-fuel ratio of the engine changes, the detection signal generally changes in accordance with the change in the average air-fuel ratio, as shown in FIG. 4. In FIG. 4, the ordinate indicates the voltage level of the detection signal from the air-fuel ratio sensor and the abscissa indicates time. Furthermore, in FIG. 4, a line g depicts a waveform of the detection signal from the air-fuel ratio sensor when the average air-fuel ratio is equal to a standard value, that is, equal to the stoichiometric air-fuel ratio; a line h depicts a waveform of the detection signal when the average air-fuel ratio is on the rich side of the stoichiometric condition, and; a line i depicts a waveform of the detection signal when the average air-fuel ratio is on the lean side of the stoichiometric condition.

As will be apparent from FIG. 4, if the average air-fuel ratio becomes on the rich side of the stoichiometric condition, the period of time during which the detection signal level is higher than or equal to a predetermined level (hereinafter called a rich signal period) becomes longer than the period of time during which the detection signal level is lower than the predetermined level, and also both the maximum value and the minimum value of the detection signal (hereinafter called a lean signal period) become higher than the maximum and minimum values which are obtained when the average air-fuel ratio is at the stoichiometric air-fuel ratio. Contrary to this, if the average air-fuel ratio becomes on the lean side of the stoichiometric condition, the rich signal period becomes shorter than the lean signal period, and also, both the maximum and minimum values of the detection signal become lower than the maximum and minimum values of the detection signal at the stoichiometric condition.

Figure 5:
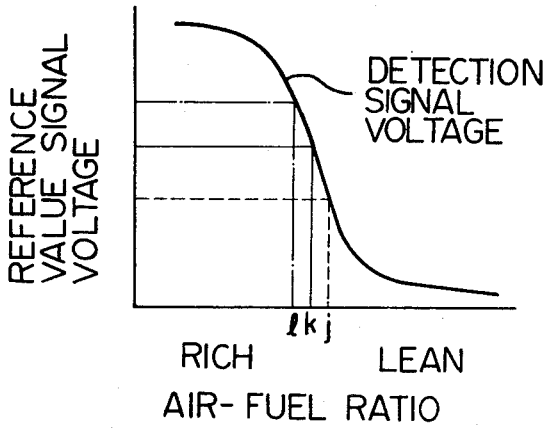
FIG. 5 is a graph illustrating the relationship between the detection signal and the actual air-fuel ratio.

Therefore, according to the embodiment illustrated in FIG. 2, if the average air-fuel ratio deviates to the rich side from the stoichiometric condition, the duration of the square-wave signal b becomes longer, and thus, the voltage level of the output signal c from the integrator 26 increases so as to cause the voltage level of the reference value signal e applied to the comparator 21 to decrease. Consequently, in such a case, the set point of the closed loop control system moves toward a value j, in FIG. 5, which is on the lean side from the standard value k. Contrary to this, if the average air-fuel ratio deviates to the lean side from the stoichiometric condition, the set point moves toward a value l, in FIG. 5, which is on the rich side from the standard value k. As a result, according to the present embodiment shown in FIG. 2, since the set point of the closed-loop air-fuel ratio control system is controlled so as to compensate for the deviation of the average air-fuel ratio, the average air-fuel ratio can be finally stabilized to a desired value. Furthermore, according to the present embodiment, since the voltage level of the reference value signal e also corresponds to the maximum value of the detection signal a from the air-fuel ratio sensor 14, changes in the voltage level of the detection signal a owing to temperature changes in environment around the sensor 14 and to deterioration of the sensor 14 can be effectively compensated.

Figure 6:
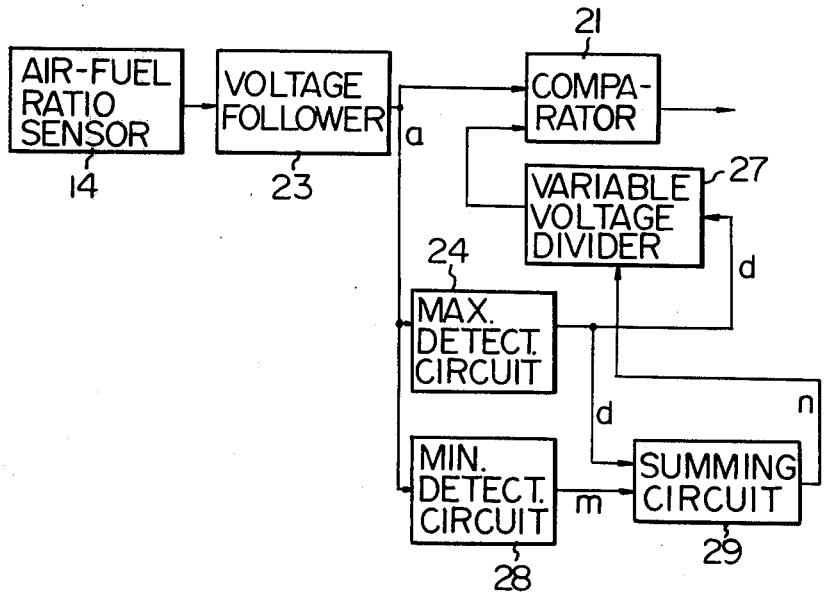
FIG. 6 is a schematic block diagram illustrating another example of the electrical circuit elements illustrated in FIG. 1.
Figure 7:
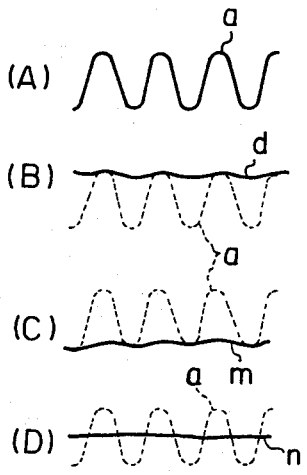
FIG. 7 contains waveforms obtained at various points in the circuit elements illustrated in FIG. 6.

FIG. 6 illustrates a second example of the circuit elements corresponding to the air-fuel ratio sensor 14, the comparator 21 and the reference value generation circuit 22, illustrated in FIG. 1, and FIG. 7 illustrates waveforms obtained at various points in the circuit elements illustrated in FIG. 6. The embodiment illustrated in FIG. 6 has the same construction as the aforementioned embodiment illustrated in FIG. 2, except that a minimum value detection circuit 28 and a summing circuit 29 are provided instead of the bistable circuit 25 and the integrator 26.

The detection signal a, shown in FIG. 7-(A), from the air-fuel ratio sensor 14 is applied to both the maximum value detection circuit 24 and the minimum value detection circuit 28 via the voltage follower 23. The minimum value detection circuit 28 produces a minimum value signal m, shown in FIG. 7-(C), having a voltage level corresponding to the minimum value of the detection signal a. This minimum value detection circuit 28 can be easily embodied in a series arrangement of a capacitor and a diode which is inversely connected with respect to the diode in the aforementioned maximum value detection circuit. The minimum value signal m is applied to the summing circuit 29 together with the maximum value signal d, shown in FIG. 7-(DB), from the maximum value detection circuit 24. The summing circuit 29 generates an output signal n, shown in FIG. 7-(D), which has a voltage level proportional to the sum of the levels of the maximum value signal d and the minimum value signal m. The output signal n from the summing circuit 29 is applied to the variable voltage divider 27 so as to control the division factor thereof. The summing circuit 29 can be embodied by a well-known summing amplifier using an operational amplifier. As is well-known, weighting with respect to the level of the input signals m and d can be easily carried out by appropriately determining the resistance of input resistors of the summing amplifier.

According to the embodiment illustrated in FIG. 6, the voltage level of the reference value signal applied to the comparator 21 can be controlled to a level corresponding to the sum of the maximum and minimum values of the detection signal from the air-fuel ratio sensor 14. Since a change in the average air-fuel ratio corresponds to a change in the maximum and minimum values of the detection signal, as described with reference to FIG. 4, the embodiment illustrated in FIG. 6 can obtain the same advantageous effects as the embodiment illustrated in FIG. 2.

Figure 9:
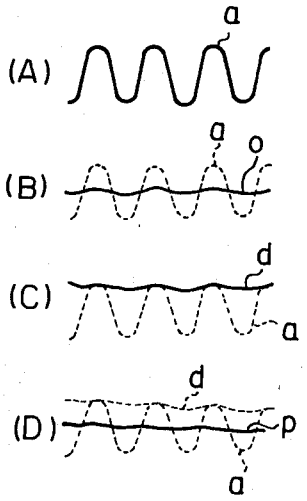
FIG. 9 contains waveforms obtained at various points in the circuit elements illustrated in FIG. 8.
Figure 8:
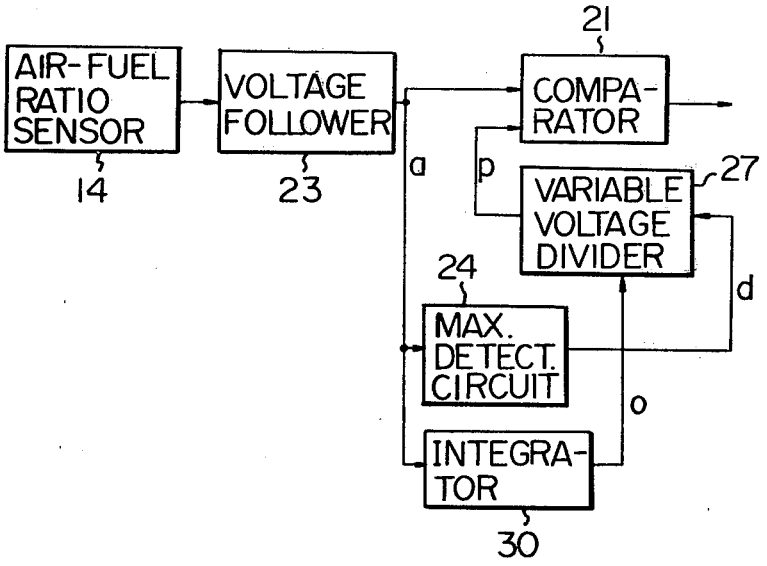
FIG. 8 is a schematic block diagram illustrating a third example of the electrical circuit elements illustrated in FIG. 1.

FIG. 8 illustrates a third example of the circuit elements corresponding to the air-fuel ratio sensor 14, the comparator 21 and the reference value generation circuit 22, illustrated in FIG. 1 and FIG. 9 illustrates waveforms obtained at various points in the circuit elements illustrated in FIG. 8. The embodiment illustrated in FIG. 8 has the same construction as the aforementioned embodiment illustrated in FIG. 2, except that an integrator 30 is provided instead of the bistable circuit 25 and the integrator 26.

The detection signal a, shown in FIG. 9-(A), from the air-fuel ratio sensor 14 via the voltage follower 23, is applied to the integrator 30. This causes an output signal o, shown in FIG. 9-(B), which indicates the average integral of the detection signal level, to be produced. The output signal o from the integrator 30 is applied to the variable voltage divider 27 so as to control the division factor thereof. The construction and operation of the variable voltage divider 27, which produces a reference value signal p, shown in FIG. 9-(D) by dividing the voltage level of the maximum value signal d, shown in FIG. 9-(C), which is applied from the maximum value detection circuit 24, are the same as those of the embodiment illustrated in FIG. 2.

According to the embodiment illustrated in FIG. 8, the voltage level of the reference value signal applied to the comparator 21 can be controlled to a level corresponding to the average integral of the detection signal from the air-fuel ratio sensor 14. Since a change in the average integral of the detection signal indicates both a change in the duty ratio of the detection signal and a change in the maximum and minimum values of the detection signal, according to the present embodiment, the deviation of the average air-fuel ratio can be more effectively compensated. The other advantageous effects of the embodiment illustrated in FIG. 8 are the same as those of the aforementioned embodiments.

As will be apparent from the foregoing description, the air-fuel ratio control apparatus according to the present invention provides: an average air-fuel ratio detection circuit, for generating a signal which indicates the average value of a detection signal from an air-fuel ratio sensor, and; a reference value control circuit, responding to the generated signal from the average air-fuel ratio detection circuit, for increasing or decreasing the reference value of a comparison circuit which compares the value of the detection signal with the reference value. Consequently, due to this construction, the average air-fuel ratio can be stabilized at a desired value and, thus, the purifying efficiency of a catalytic converter can be greatly increased.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control apparatus for an internal combustion engine having an exhaust system and means for supplying secondary air to the exhaust system, said apparatus comprising:

sensor means disposed in the exhaust system, for detecting the concentration value of a predetermined constituent in the exhaust gas of the engine, said sensor means generating a first signal which indicates the concentration value of the predetermined constituent in the exhaust gas;

first circuit means for calculating the average value of the first signal from said sensor means, said first circuit means generating a second signal indicative of the calculated average value that represents the closed loop air-fuel ratio in the exhaust system to which the secondary air is supplied;

second circuit means for generating a reference signal based upon the first signal and the second signal, comprising means for detecting the maximum value of the first signal and means for dividing the signal derived from said maximum value detecting means by a variable division factor, to generate the reference signal, said variable division factor being continuously changed responding to said second signal;

third circuit means for making a comparison between the values of said first signal and said reference signal, said third circuit means generating a control signal which indicates the result of said comparison; and means for adjusting the amount of secondary air supplied to the exhaust system in response to said control signal from the third circuit means.

2. An air-fuel ratio control apparatus as claimed in claim 1, wherein said first circuit means includes means for integrating said first signal with respect to time, said means for integrating said first signal producing an integrated output signal which is applied to said means for dividing the signal derived from said maximum value so as to control the variable division factor of said means for dividing.

3. An air-fuel ratio control apparatus as claimed in claim 1, wherein said first circuit means includes bistable circuit means for converting said first signal into a square wave signal and means for integrating said square wave signal with respect to time, said means for integrating said square wave with respect to time producing an integrated output signal which is applied to said means for dividing the signal derived from said maximum value so as to control the variable division factor of said means for dividing.

* * * * *